US008156909B2

(12) United States Patent
Seo

(10) Patent No.: US 8,156,909 B2
(45) Date of Patent: Apr. 17, 2012

(54) END PIVOT VALVE TRAIN

(75) Inventor: Jong Sul Seo, Incheon (KR)

(73) Assignees: Hyundai Motor Company, Seoul (KR); Kia Motors Corporation, Seoul (KR)

( * ) Notice: Subject to any disclaimer, the term of this patent is extended or adjusted under 35 U.S.C. 154(b) by 374 days.

(21) Appl. No.: 12/605,977

(22) Filed: Oct. 26, 2009

(65) Prior Publication Data

US 2010/0139595 A1 Jun. 10, 2010

(30) Foreign Application Priority Data

Dec. 5, 2008 (KR) ..... 10-2008-0123675

(51) Int. Cl.
*F01L 1/18* (2006.01)

(52) U.S. Cl. ..... 123/90.44; 123/90.39; 123/90.45; 123/90.46; 74/559; 74/569

(58) Field of Classification Search ..... 123/90.39, 123/90.44, 90.45, 90.46; 74/559, 567, 569
See application file for complete search history.

(56) References Cited

U.S. PATENT DOCUMENTS 4,791,893 A 12/1988 Muranaka et al.
7,757,646 B2 * 7/2010 Kumagai et al. ..... 123/90.38

FOREIGN PATENT DOCUMENTS

EP 0 907 008 A1 4/1999
JP 58-211514 A 12/1983
JP 2007-192101 A 8/2007

* cited by examiner

*Primary Examiner* — Ching Chang
(74) *Attorney, Agent, or Firm* — Morgan, Lewis & Bockius LLP

(57) ABSTRACT

An end pivot valve train is provided in a cylinder head to open and close a cylinder valve. The end pivot valve train includes a cam follower forcing the cylinder valve, and a cam holder assembled onto an upper portion of the cylinder head and includes a receiving groove to receive the cam follower therein, wherein the cam holder has a protrusion configured and dimensioned to interfere with an upper surface of the cam follower when the cam follower rotates such that a longitudinal edge thereof moves up.

7 Claims, 5 Drawing Sheets

END PIVOT VALVE TRAIN

CROSS-REFERENCE TO RELATED APPLICATION

The present application claims priority to Korean Patent Application Number 10-2008-123675 filed Dec. 5, 2008, the entire contents of which application is incorporated herein for all purposes by this reference.

BACKGROUND OF THE INVENTION

1. Field of the Invention

The present invention relates to an end pivot valve train, and more particularly, to an end pivot valve train in which a support protrusion is provided on a cam holder so as to prevent the cam follower from falling towards a rotation axis of a cam during the assembly of the valve train.

2. Description of Related Art

Generally, an engine, particularly, an internal combustion engine is an apparatus transforming thermal energy into a mechanical rotating force. The engine burns fuel in a combustion chamber defined by a cylinder, a cylinder head, and a piston reciprocating in the cylinder to generate explosive force, which rotates a crankshaft through a connecting rod connected to the piston.

On the cylinder head of such an engine, provided are an intake valve for providing a fuel-air mixture to be combusted in the combustion chamber and an exhaust valve for exhausting combustion gas. The intake valve and the exhaust valve are configured to be opened and closed by a valve opening and closing mechanism connected to the crankshaft.

Here, the valve opening and closing mechanism is generally of an overhead valve type and an overhead camshaft type, both of which transform a cam motion of a camshaft, rotatably connected with the crankshaft, into a linear motion of a valve. For the linear motion of the valve along a curve of a cam, the valve is required to always come into close contact with the cam (or an operating device connected to the cam).

The assembly structure of an end pivot valve train of the prior art will now be described with reference to accompanying drawings.

FIG. 1 is a cross-sectional view illustrating the assembly of the end pivot valve train of the prior art, and FIG. 2 is a front elevation view illustrating the end pivot valve train as seen in a direction A.

The end pivot valve train includes a cam follower 110 and a Hydraulic Lash Adjuster (HLA) 130. One end of the cam follower 110 is in direct contact with a stem end 121 of a valve 120 to operate the valve 120 through the rotation of a cam 145. The HLA 130 is in contact with the other end of the cam follower, and serves as a support axis for the cam follower 110 when the cam follower 110 is transmitting a rotating motion of the cam 145 to the valve 120.

Therefore, the cam follower 110 has a support structure such that the opposite ends are respectively supported by the valve 120 and the HLA 130 and a middle portion is supported by the cam 145.

However, such an end pivot valve train has a following problem. Since an assembly process is completed by placing the cam follower 110 on the valve 120 and the HLA 130, placing the camshaft 140 on the cam follower 110, and then installing a bearing (not shown) of the camshaft on the camshaft 140, the cam follower 110 placed on both the valve 120 and the HLA 130 can hardly maintain the steadily-supported position during the connection with the camshaft 140.

That is, since there is no means for securely supporting the cam follower 110, with one end of the cam follower 110 in contact with the stem end 121 of the valve 120 and the other end of the cam follower 110 in contact with the upper portion of the HLA 130, the assembled state of the cam follower 110 may be made unstable by a force acting in other directions than a vertical direction during the assembly process of the camshaft 140.

The information disclosed in this Background of the Invention section is only for enhancement of understanding of the general background of the invention and should not be taken as an acknowledgement or any form of suggestion that this information forms the prior art already known to a person skilled in the art.

BRIEF SUMMARY OF THE INVENTION

Various aspects of the present invention are directed to provide an end pivot valve train in which a support protrusion is provided on a cam holder so as to prevent the cam follower from falling towards a rotation axis of a cam.

In an aspect of the present invention, an end pivot valve train provided in a cylinder head to open and close a cylinder valve, may include a cam follower forcing the cylinder valve, and a cam holder assembled onto an upper portion of the cylinder head and includes a receiving groove to receive the cam follower therein, wherein the cam holder has a protrusion configured and dimensioned to interfere with an upper surface of the cam follower when the cam follower rotates such that a longitudinal edge thereof moves up.

The protrusion may have a width narrower than that of the cam follower and the upper surface of the cam follower has a recess conforming to the protrusion The protrusion may extend from a lower portion of the receiving groove towards an upper portion of one end of the cam follower, wherein a hydraulic lash adjuster is coupled to the one end of the cam follower downwards.

The protrusion may extend from a lower portion of the receiving groove in a forward direction towards an upper portion of one end of the cam follower, wherein a hydraulic lash adjuster is coupled to the one end of the cam follower downwards.

The cam follower can be stably supported without deviating from a proper position despite of abnormal operation of valve mechanism when the end pivot valve train is being assembled.

The methods and apparatuses of the present invention have other features and advantages which will be apparent from or are set forth in more detail in the accompanying drawings, which are incorporated herein, and the following Detailed Description of the Invention, which together serve to explain certain principles of the present invention.

DETAILED DESCRIPTION OF THE INVENTION

Reference will now be made in detail to various embodiments of the present invention(s), examples of which are illustrated in the accompanying drawings and described below. While the invention(s) will be described in conjunction with exemplary embodiments, it will be understood that present description is not intended to limit the invention(s) to those exemplary embodiments. On the contrary, the invention(s) is/are intended to cover not only the exemplary embodiments, but also various alternatives, modifications, equivalents and other embodiments, which may be included within the spirit and scope of the invention as defined by the appended claims.

Figure 1:
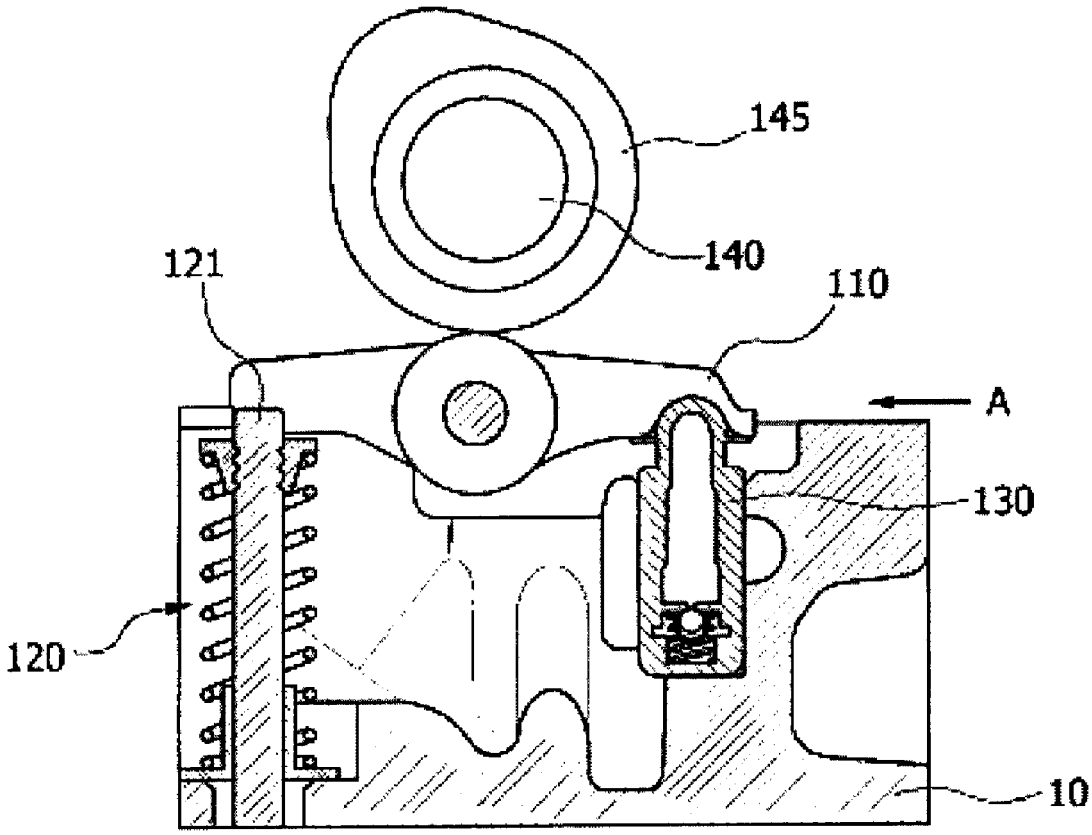
FIG. 1 (Prior Art)
FIG. 1 is a cross-sectional view illustrating the assembly of the end pivot valve train of the prior art.
Figure 2:
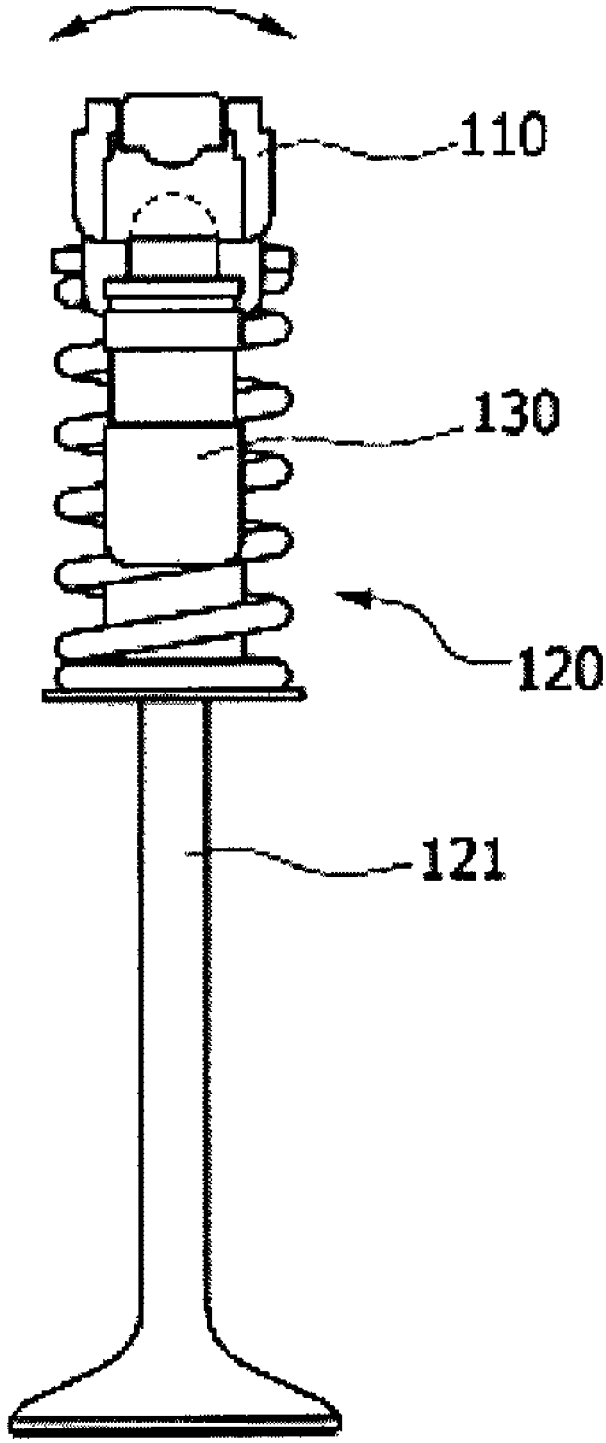
FIG. 2 (Prior Art)
FIG. 2 is a front elevation view illustrating the end pivot valve train as seen in a direction A.
Figure 3:
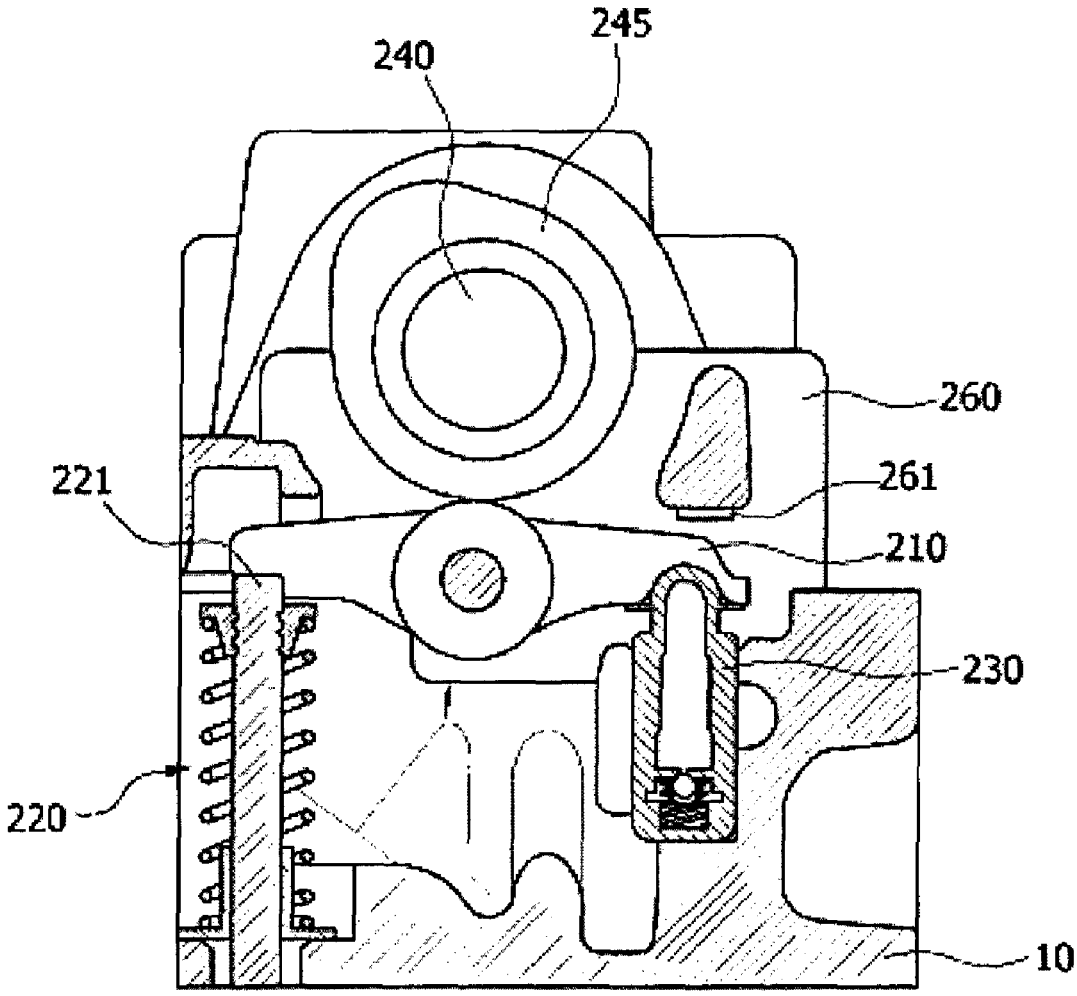
FIG. 3 is a cross-sectional view illustrating the assembled state of an exemplary end pivot valve train according to the present invention.
Figure 4:
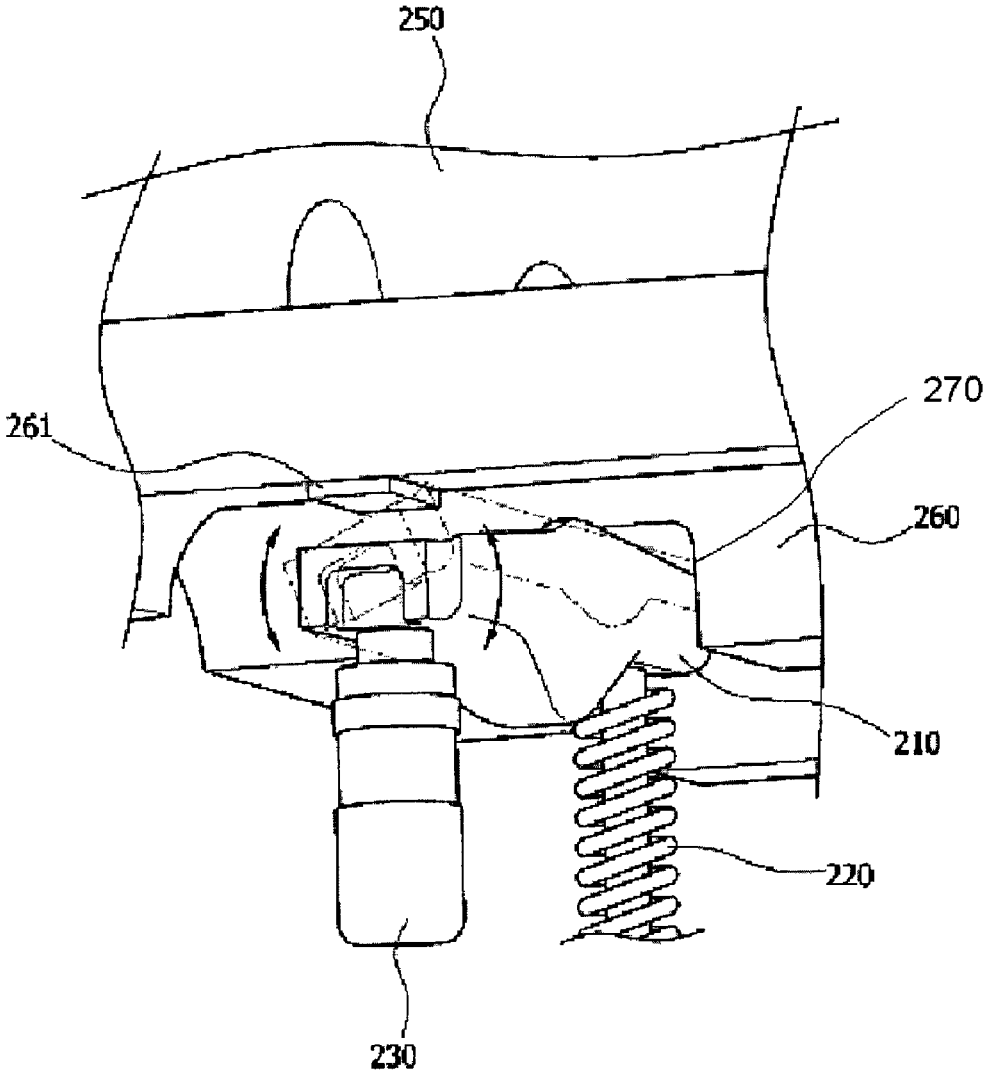
FIG. 4 is a perspective view illustrating the assembled state of the exemplary end pivot valve train according to the present invention.

FIG. 3 is a cross-sectional view illustrating the assembled state of an exemplary end pivot valve train according to the present invention, and FIG. 4 is a perspective view illustrating the assembled state of the exemplary end pivot valve train according to the present invention.

The end pivot valve train of the present invention is installed onto a cylinder head 10 to open and close a valve 220 of a cylinder. The end pivot valve train includes a cam follower 210 transforming a rotating motion of a cam 245 into a vertical motion of the valve 220, and a cam holder 260 with a protrusion allowing the supported position of the cam follower 210 to be maintained during the assembly of the valve train. The cam holder includes a receiving groove 270 to receive a cam follower 210 therein.

The cam follower 210 is supported by a hydraulic lash adjuster (HLA) 230 and a stem head 221 of the valve, particularly, with one end in contact with the upper portion of the HLA 230 and the other end of the cam follower 210 in contact with the stem head 221. In assembly, the cam holder 260, a camshaft 240, and the like are assembled after the cam follower 210 has been supported onto the HLA 230 and the valve 220. The cam follower 210 holds the completely-supported position through contact with the cam 245 upon the assembly of the can shaft 240. The cam follower 210 opens and closes the valve 220 while transmitting a motion of the cam 245 to the valve 220 as the camshaft 240 rotates.

The cam holder 260 is fixed to the upper portion of the cylinder head 10, and has the protrusion 261 protruding from the lower portion towards the upper portion of the other end of the cam follower 210. The protrusion 261 is of a width smaller than that of the cam follower 210. A cam cap 250 is fixedly assembled on the camshaft 240, which is installed on the cam holder 260.

Since the assembly process of the end pivot valve train is not carried out at one place, the cam follower 210 is first installed, the cam holder 260 is then pre-assembled, and the camshaft 240 is finally assembled. Before the assembly of the camshaft 240, when the cam follower 210 rotates such that one longitudinal edge thereof moves up or down, the protrusion 261 of the pre-assembled cam holder 260 interferes with the upper surface of the cam follower 210 so as to support the cam follower 210 such that it does not fall.

As illustrated in FIG. 4, the cam follower 210, supported with the opposite ends thereof, may shake about support points on the opposite ends thereof but will not fall down through interference with the protrusion 261 of the cam holder 260 when the cam holder 260 is pre-assembled to the cam follower 210. In this state, when the camshaft (not shown) is installed thereto, the cam follower 210 comes to a completely-supported position.

Figure 5:
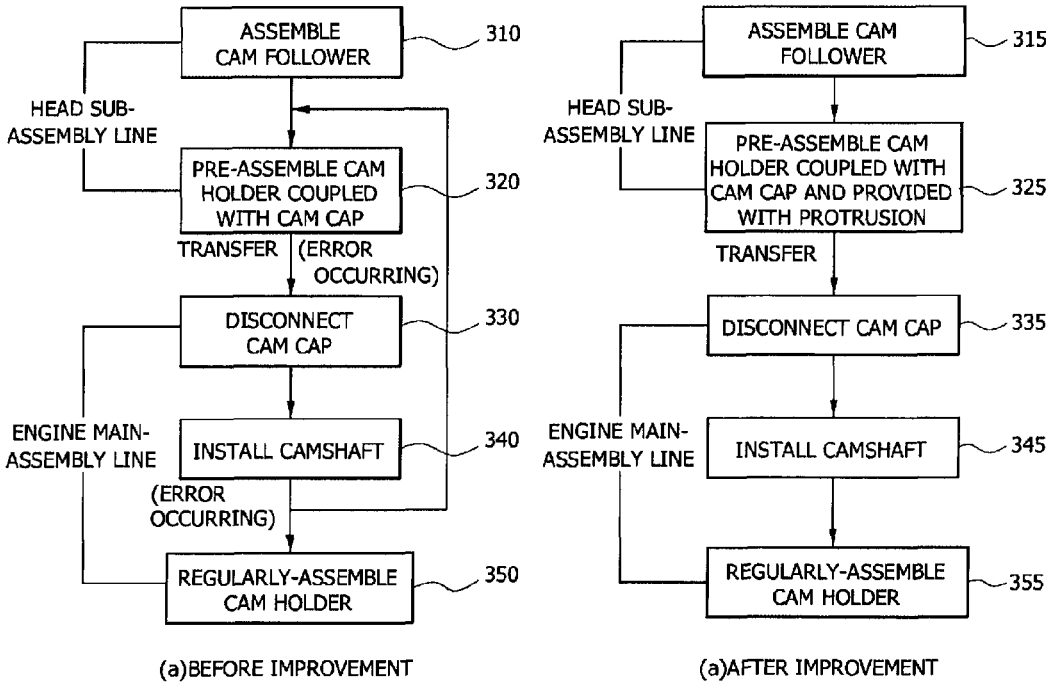
FIG. 5 is flowcharts illustrating assembly processes before and after improvements in the exemplary end pivot valve train according to the present invention.

FIG. 5 is flowcharts illustrating assembly processes before and after improvements in the exemplary end pivot valve train according to the present invention.

With reference to FIG. 5, a description will be given of an assembly process of the end pivot valve train. First, in the state where the HLA and the valve are assembled to the cylinder head, the cam follower is installed on the upper portions of the HLA and the valve (step 310). The cam holder coupled with the cam cap is pre-assembled to the cam follower (step 320). These assembly steps are carried out in a head sub-assembly line, and after these steps, the resultant cylinder head is transferred to an engine main-assembly line. In the engine main-assembly line, the cam cap is disconnected from the cam holder and the camshaft is installed on the cam holder (step 340). After the camshaft is installed, the cam holder is regularly-assembled to the cam follower (step 350). Next, the disconnected cam cap is assembled to the camshaft.

In this assembly process, if the cam holder without a protrusion is used, the cam follower often falls down from the supported position when the pre-assembled structure is transferred from the head sub-assembly line to the engine main-assembly line or when the cam is installed. When the cam follower falls down, required is a re-assembly process of disconnecting the pre-assembled cam holder again and then bringing the cam follower into contact with the upper portion of the HLA and the valve.

However, in case of using the cam holder with the protrusion formed thereon according to various embodiments of the invention, when the pre-assembled structure is transferred in the state where the cam follower is installed (step 315) and the cam holder is pre-assembled (step 325), the valve train does not fall down at all through interference with the protrusion of the cam holder even if it shakes. This construction as a result makes it possible to sequentially carry out the steps of disconnecting the cam cap (step 335), installing the camshaft onto the cam holder (step 345), and then regularly-assembling the cam holder.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described in order to explain certain principles of the invention and their practical application, to thereby enable others skilled in the art to make and utilize various exemplary embodiments of the present invention, as well as various alternatives and modifications thereof. It is intended that the scope of the invention be defined by the Claims appended hereto and their equivalents.

What is claimed is:

1. An end pivot valve train of a cylinder head to open and close a cylinder valve, comprising:

a cam follower forcing the cylinder valve; and a cam holder assembled onto an upper portion of the cylinder head and includes a receiving groove to receive the cam follower therein, wherein the cam holder has a protrusion configured and dimensioned to interfere with an upper surface of the cam follower when the cam follower rotates such that a longitudinal edge thereof moves up.

2. The end pivot valve train according to claim 1, wherein the protrusion has a width narrower than that of the cam follower and the upper surface of the cam follower has a recess conforming to the protrusion.

3. The end pivot valve train according to claim 1, wherein the protrusion extends from a lower portion of the receiving groove towards an upper portion of one end of the cam follower.

4. The end pivot valve train according to claim 3, wherein a hydraulic lash adjuster is coupled to the one end of the cam follower downwards.

5. The end pivot valve train according to claim 1, wherein the protrusion extends from a lower portion of the receiving groove in a forward direction towards an upper portion of one end of the cam follower.

6. The end pivot valve train according to claim 5, wherein a hydraulic lash adjuster is coupled to the one end of the cam follower downwards.

7. A vehicle engine cylinder head comprising the end pivot valve train according to claim 1.

* * * * *